US008545058B2

(12) United States Patent
Chen et al.

(10) Patent No.: US 8,545,058 B2
(45) Date of Patent: Oct. 1, 2013

(54) LENS AND ILLUMINATION DEVICE

(75) Inventors: Chin-Chung Chen, New Taipei (TW); Sheng-Jie Qiao, Shenzhen (CN)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 236 days.

(21) Appl. No.: 13/187,538

(22) Filed: Jul. 21, 2011

(65) Prior Publication Data

US 2012/0268946 A1 Oct. 25, 2012

(30) Foreign Application Priority Data

Apr. 19, 2011 (CN) ..... 2011 1 0097310

(51) Int. Cl.
*F21S 8/00* (2006.01)

(52) U.S. Cl.
USPC ..... 362/268; 362/311.06

(58) Field of Classification Search
USPC ..... 362/268, 311.01, 311.02, 311.06, 362/311.09, 311.1, 311.15
See application file for complete search history.

(56) References Cited

U.S. PATENT DOCUMENTS

| | | | | |
|---|---|---|---|---|
| 7,988,338 | B2 * | 8/2011 | Zhou | 362/311.02 |
| 2010/0073938 | A1 * | 3/2010 | Ho | 362/335 |
| 2010/0328941 | A1 * | 12/2010 | Zhang et al. | 362/235 |
| 2011/0235338 | A1 * | 9/2011 | Chen et al. | 362/311.02 |
| 2011/0317432 | A1 * | 12/2011 | Lee | 362/335 |

* cited by examiner

*Primary Examiner* — Julie Shallenberger
(74) *Attorney, Agent, or Firm* — Altis Law Group, Inc.

(57) ABSTRACT

A lens includes a light incident surface and a light exiting surface. The light exiting surface includes a first concave surface, a first convex surface, a second convex surface, a first curved surface, and a second curved surface. The first concave surface is located at the center of the light exiting surface for diverging the light exiting therefrom. The first and second convex surface are arranged at two opposite sides of the first concave surface respectively for converging the light exiting therefrom; the first convex surface, the first concave surface, and the second convex surface connect in sequence along a first direction. The first and second curved surfaces are arranged at another two opposite sides of the first concave surface respectively; the first curved surface, the first concave surface, and the second curved surface connect in sequence along a second direction perpendicular to the first direction.

20 Claims, 6 Drawing Sheets

LENS AND ILLUMINATION DEVICE

BACKGROUND

1. Technical Field

The present disclosure relates to optical field and, particularly, to a lens and an illumination device having the lens.

2. Description of Related Art

At present, the light emitted from many types of light sources, such as light emitting diodes, discharge lamps, and halogen lamps etc., has a large divergence angle. When one of these types of light sources is provided for illumination, a focus lens is generally required at the front of it to reduce the divergence angle. Typically, the focus lens makes the illumination area of the light source round, however, in some products, such as road lamps etc., the illumination area of the light source should be rectangular to improve the efficiency of the light utilization of the light source.

What is needed is a lens which can ameliorate the problem of the prior art.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Embodiments of the present disclosure will now be described in detail below, with reference to the accompanying drawings.

Figure 1:
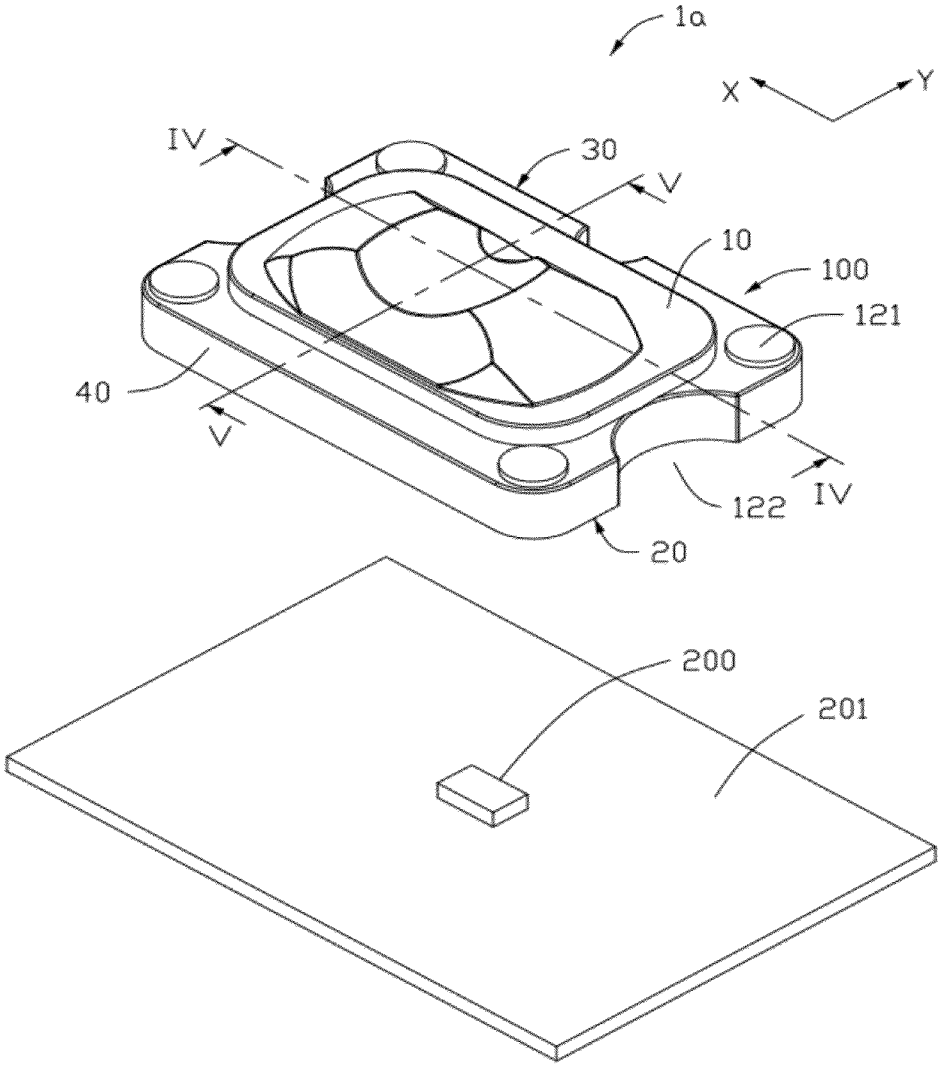
FIG. 1 is a schematic view of an illumination device according to an exemplary embodiment.

Referring to FIG. 1, an illumination device 1*a* according to an exemplary embodiment is shown. The illumination device 1*a* includes a lens 100 and a light source 200. The illumination device 1*a* can be used in a road lamp, a garden lamp, etc.

The light source 200 can be a light emitting diode, a discharge lamp, or a halogen lamp etc. In the present embodiment, the light source 200 is a light emitting diode, and the light emitting diode is mounted on a circuit board 201.

The lens 100 includes a first surface 10, a second surface 20 opposite to the first surface 10, a first side surface 30 connecting between the first surface 10 and the second surface 20, and a second side surface 40 connecting between the first surface 10 and the second surface 20 and opposite to the first side surface 30. When the illumination device 1*a* is used as a road lamp, the first side surface 30 will be arranged facing towards the center of a road, and the second side surface 40 will be arranged facing away from the center of the road. The first side surface 30 and the second side surface 40 are substantially parallel to the road.

Figure 2:
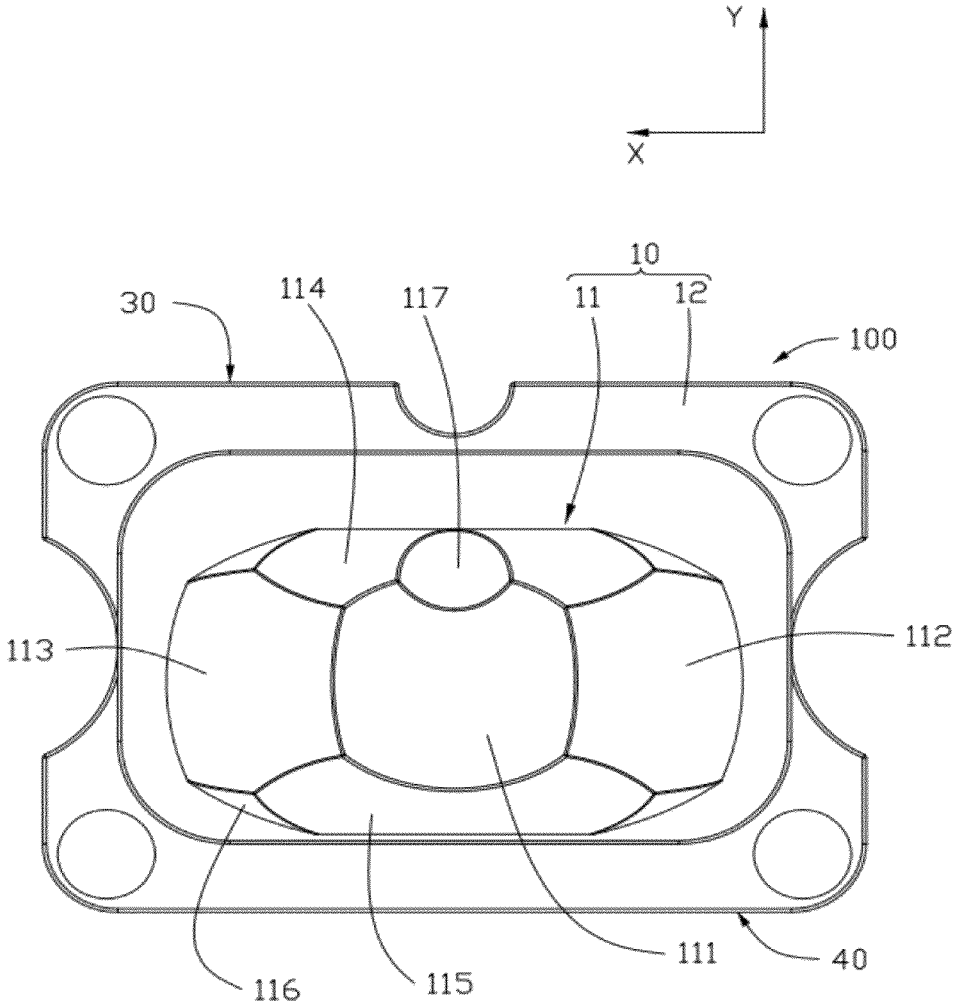
FIG. 2 is a schematic view of a lens of the illumination device of FIG. 1, viewed from the light exiting side of the lens.

Further referring to FIG. 2, the first surface 10 of the lens 100 includes a light exiting surface 11 at the center of the lens 100, and a mounting surface 12 surrounding the light exiting surface 11. The mounting surface 12 is configured for engaging with a lamp housing (not shown) to fix the lens 100 to the housing, during assembling of the lens 100. In the present embodiment, the lens 100 has four cylindrical protrusions 121 at four corners of the mounting surface 12 of the lens 100 respectively; the cylindrical protrusions 121 are configured for fixing the lens 100 to the housing conveniently. The lens 100 defines three cutouts 122 running through the first surface 10 and the second surface 20 at three sides of the lens 100. The cutouts 122 can provide positioning function thereby to improve the efficiency of assembling the lens 100 into a lamp.

The light exiting surface 11 protrudes from the center of the first surface 10. The length of the light exiting surface 11 along the first direction X is larger than the length of the light exiting surface 11 along the second direction Y. The first direction X is substantially perpendicular to the second direction Y. When the illumination device la is used as a road lamp, the first direction X will be arranged substantially parallel to the road, and the second direction Y will be arranged substantially perpendicular to the road. In the present embodiment, the light exiting surface 11 is substantially oval-shaped.

The light exiting surface 11 includes a first concave surface 111, a first convex surface 112, a second convex surface 113, a first curved surface 114, a second curved surface 115, and four connecting surfaces 116. The first concave surface 111 is located at the center of the light exiting surface 11. The first convex surface 112 and the second convex surface 113 are arranged at two opposite sides of the first concave surface 111. The first convex surface 112, the first concave surface 111, and the second convex surface 113 are connected in sequence along the first direction X. The first curved surface 114 and the second curved surface 115 are arranged at another two opposite sides of the first concave surface 111. The first curved surface 114, the first concave surface 111, and the second curved surface 115 are connected in sequence along the second direction Y. The four connecting surfaces 116 are arranged at four corners of the light exiting surface 11 respectively.

The first concave surface 111 can diverge the light exiting therefrom. The light diverging power of the first concave surface 111 on the first direction X is larger than the light diverging power of the first concave surface 111 on the second direction Y. Thus, the light exiting from the first concave surface 111 has a relatively larger divergence angle on the first direction X, and has a relatively smaller divergence angle on the second direction Y. In the present embodiment, the first concave surface 111 is an ellipsoidal surface with a long axis thereof substantially parallel to the second direction Y, and a short axis thereof substantially parallel to the first direction X.

The first convex surface 112 and the second convex surface 113 can converge the light exiting therefrom. The light converging power of the first convex surface 112 on the first direction X is smaller than the light converging power of the first convex surface 112 on the second direction Y. The light converging power of the second convex surface 113 on the first direction X is smaller than the light converging power of the second convex surface 113 on the second direction Y. Thus, the light exiting from the first convex surface 112 and the second convex surface 113 has a relatively larger divergence angle on the first direction X, and has a relatively smaller divergence angle on the second direction Y. In the present embodiment, each of the first convex surface 112 and the second convex surface 113 is an ellipsoidal surface with a long axis thereof substantially parallel to the first direction X, and a short axis thereof substantially parallel to the second direction Y.

The first curved surface 114 and second curved surface 115 can diverge the light exiting therefrom on the first direction X, and can converge the light exiting therefrom on second direction Y. In the present embodiment, each of the first curved surface 114 and second curved surface 115 is a cylindrical surface.

The four connecting surfaces 116 can converge the light exiting therefrom. In the present embodiment, each of the four connecting surfaces 116 is an ellipsoidal surface with a long axis thereof substantially parallel to the first direction X, and a short axis thereof substantially parallel to the second direction Y. Each of the four connecting surfaces 116 is connected with one of the first convex surface 112 and the second convex surface 113, one of the first curved surface 114 and the second curved surface 115, and the mounting surface 12. The light converging power of each connecting surface 116 on the first direction X is smaller than the light converging power of first convex surface 112 and the second convex surface 113 on the first direction X. The light converging power of each connecting surface 116 on the second direction Y is larger than the light converging power of the first curved surface 114 and the second curved surface 115 on the second direction Y.

In the present embodiment, the light exiting surface 11 further includes a second concave surface 117. The second concave surface 117 is arranged at a side of the first concave surface 111 adjacent to the first curved surface 114, and is connected to the first concave surface 111 and the first curved surface 114. The second concave surface 117 is substantially at the center of the first curved surface 114. The light converging power of the second concave surface 117 on the second direction Y is smaller than the light converging power of the first curved surface 114 on the second direction Y; thus, there will be more amount of light exiting from the light exiting surface 11 shining towards a side of the lens 100 adjacent to the first curved surface 114. The light diverging power of the second concave surface 117 on the first direction X is larger than the light diverging power of the first concave surface 111 on the first direction X; thus, the light exiting from the light exiting surface 11 will be more uniformly distributed. When the illumination device 1*a* is used as a road lamp, the first curved surface 114 will be arranged adjacent to the center of the road, and the second curved surface 115 will be arranged away from the center of the road. Because the second concave surface 117 can make more amount of light exiting from the light exiting surface 11 shining towards the side of the lens 100 adjacent to the first curved surface 114; therefore, there will be more amount of light shining towards the center of the road. The second concave surface 117 is an ellipsoidal surface with a long axis thereof substantially perpendicular to the first direction X, and a short axis thereof substantially parallel to the first direction X. The long axis of the second concave surface 117 and the long axis of the first concave surface 111 can be coincident, and the light exiting surface 11 can be symmetrical relative to the long axis of the second concave surface 117 or the first concave surface 111.

It is understood, the shapes of the first concave surface 111, the first convex surface 112, the second convex surface 113, the first curved surface 114, the second curved surface 115, the connecting surfaces 116, and the second concave surface 117 are not limited to the present embodiment; these surfaces can also be other shapes which have the corresponding functions.

Figure 3:
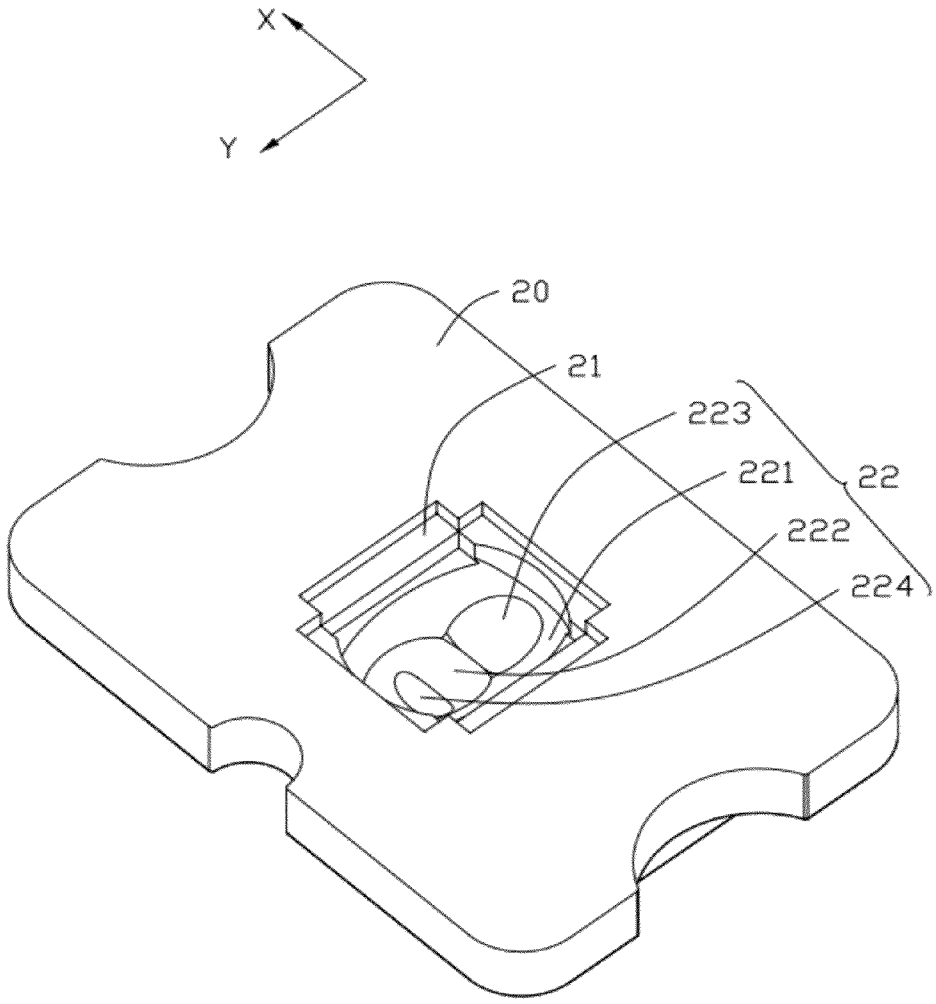
FIG. 3 is a schematic view of the lens of FIG. 2, viewed from the light incident side of the lens.
Figure 4:
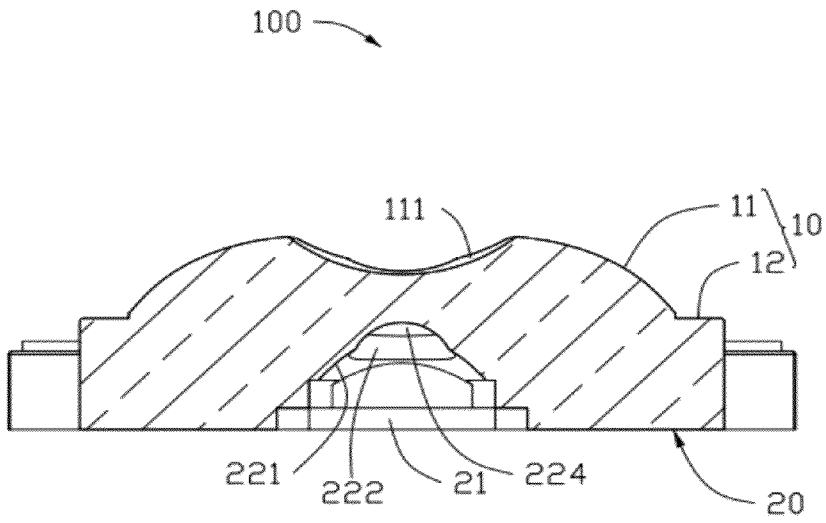
FIG. 4 is a cross sectional view of a lens of the illumination device of FIG. 1 taken along line IV-IV of FIG. 1.
Figure 5:
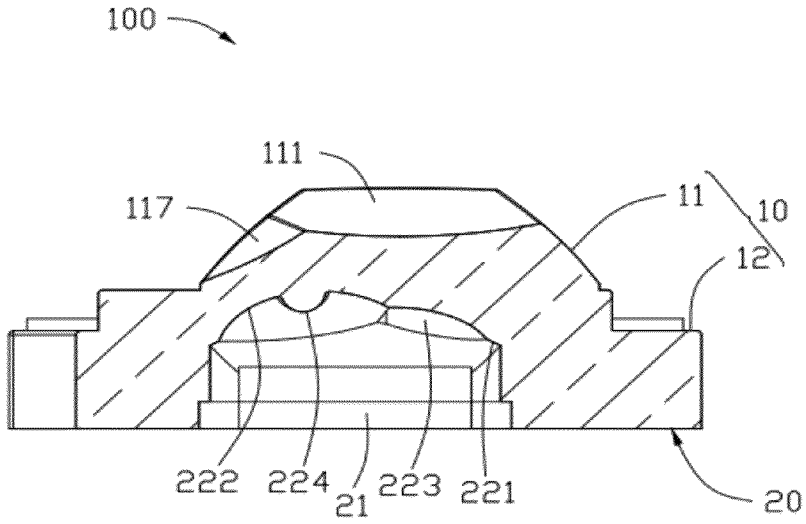
FIG. 5 is a cross sectional view of a lens of the illumination device of FIG. 1 taken along line V-V of FIG. 1.

Further referring to FIGS. 3-5, the second surface 20 of the lens 100 defines a receiving groove 21 at the center thereof. The receiving groove 21 is used for receiving the light source 200. The lens 100 includes a light incident surface 22 at the bottom of the receiving groove 21. The light incident surface 22 can be a flat surface or a curved surface. In the present embodiment, the light incident surface 22 includes a number of curved surfaces. In order to increase the amount of light exiting from the light exiting surface 11 shining towards the side of the lens 100 adjacent to the first curved surface 114, the receiving groove 21 can be arranged adjacent to the first curved surface 114 relative to the second curved surface 115. In other embodiments, the receiving groove 21 can also be omitted, and the light source 200 is arranged at a side of the lens 100 facing the second surface 20.

In the present embodiment, the light incident surface 22 includes a first concave curved surface 221, a second concave curved surface 222, a third concave curved surface 223, and a convex curved surface 224 in the second concave curved surface 222. The second concave curved surface 222 and the third concave curved surface 223 intersect each other, and both of the second concave curved surface 222 and the third concave curved surface 223 are arranged in the first concave curved surface 221. The convex curved surface 224 is arranged in the second concave curved surface 222. The second concave curved surface 222 and the third concave curved surface 223 are connected along the second direction Y. The second concave curved surface 222 is arranged adjacent to the first curved surface 114, and the third concave curved surface 223 is arranged away from the first curved surface 114.

The first concave curved surface 221 can diverge the light accessing therein. The light diverging power of the first concave curved surface 221 on the first direction X is larger than the light diverging power of the first concave curved surface 221 on the second direction Y. For example, the first concave curved surface 221 can be an ellipsoidal surface with a long axis thereof substantially parallel to the second direction Y, and a short axis thereof substantially parallel to the first direction X.

The light diverging power of each of the second concave curved surface 222 and the third concave curved surface 223 is larger than that of the first concave curved surface 221 on both the first direction X and the second direction Y. In order to increase the amount of light exiting from the light exiting surface 11 shining towards the side of the lens 100 adjacent to the first curved surface 114, the area of the second concave curved surface 222 can be designed larger than that of the third concave curved surface 223. Each of the second concave curved surface 222 and the third concave curved surface 223 can be an ellipsoidal surface with a long axis thereof substantially parallel to the second direction Y, and a short axis thereof substantially parallel to the first direction X.

The convex curved surface 224 is configured for increasing the amount of light exiting from the light exiting surface 11 shining towards the side of the lens 100 adjacent to the first curved surface 114. The convex curved surface 224 can be an ellipsoidal surface with a long axis thereof substantially parallel to the first direction X, and a short axis thereof substantially parallel to the second direction Y. The convex curved surface 224 can avoid the illumination area of the illumination device 1*a* having a too bright center area, and therefore, can make the light exiting from the light exiting surface 11 be more uniformly distributed.

The first concave surface 111, the first convex surface 112, the second convex surface 113, the first curved surface 114, and the second curved surface 115 cooperatively can make the illumination device 1*a* have a substantially rectangular illumination area. The connecting surfaces 116 can converge the light exiting from the four corners of the light exiting surface 11, and therefore control the shape of four corners of the illumination area of the illumination device 1*a*.

Figure 6:
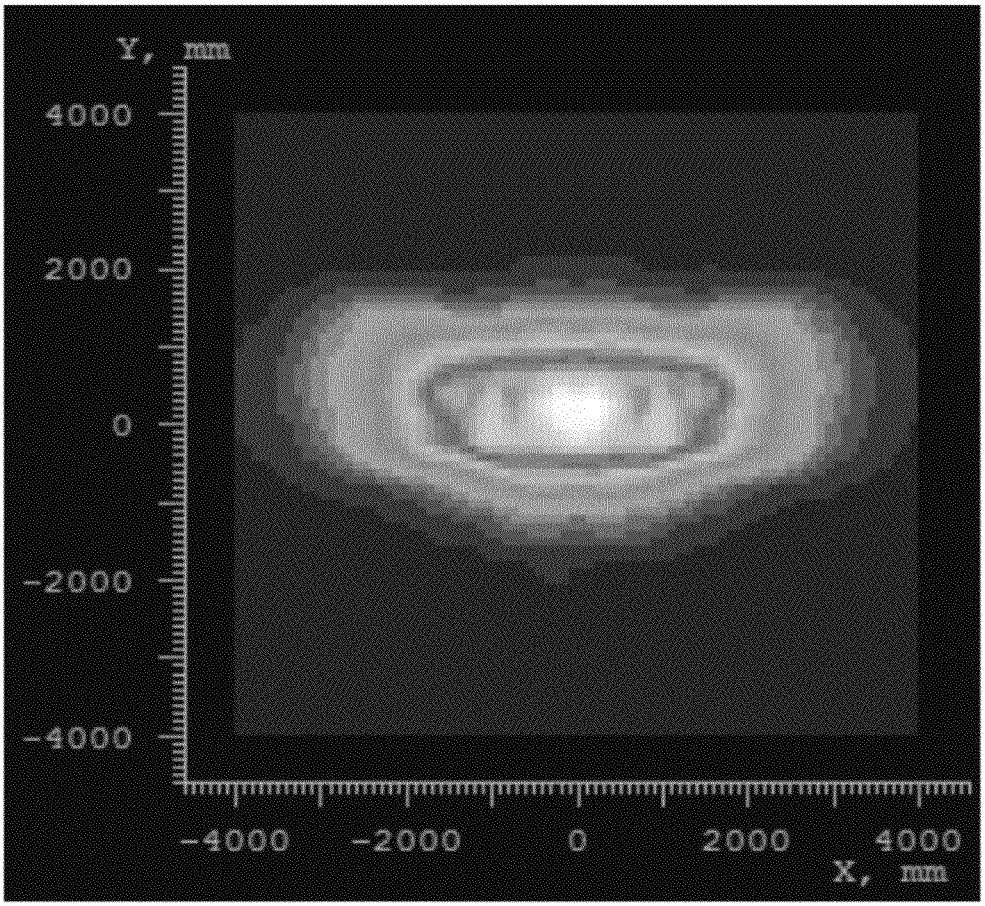
FIG. 6 is an illuminance distribution map of the illumination device of FIG. 1.

Referring to FIG. 6, from the illuminance distribution map of the illumination device 1*a*, it can be found that the illumination area of the illumination device 1*a* is substantially rectangular, and the illumination device 1*a* has a relative uniform light distribution.

While certain embodiments have been described and exemplified above, various other embodiments will be apparent to those skilled in the art from the foregoing disclosure. The disclosure is not limited to the particular embodiments described and exemplified, and the embodiments are capable of considerable variation and modification without departure from the scope and spirit of the appended claims.

What is claimed is:

1. A lens comprising:

a light incident surface; and a light exiting surface, the light exiting surface comprising:

a first concave surface located at a center of the light exiting surface for diverging light exiting therefrom;

a first convex surface and a second convex surface arranged at two opposite sides of the first concave surface respectively for converging the light exiting therefrom, the first convex surface, the first concave surface, and the second convex surface connecting in sequence along a first direction;

a first curved surface and a second curved surface arranged at another two opposite sides of the first concave surface respectively, the first curved surface, the first concave surface, and the second curved surface connecting in sequence along a second direction, the second direction being substantially perpendicular to the first direction;

wherein, the light diverging power of the first concave surface on the first direction is larger than the light diverging power of the first concave surface on the second direction, the light converging power of each of the first convex surface and the second convex surface on the first direction is smaller than the light converging power of each of the first convex surface and the second convex surface on the second direction, the first curved surface and second curved surface diverge the light exiting therefrom on the first direction, and converge the light exiting therefrom on the second direction; and wherein the first concave surface is an ellipsoidal surface with a long axis thereof substantially parallel to the second direction, and a short axis thereof substantially parallel to the first direction.

2. The lens as claimed in claim 1, wherein the length of the light exiting surface along the first direction is larger than the length of the light exiting surface along the second direction.

3. The lens as claimed in claim 1, wherein the lens is used in a road lamp, the first direction is arranged substantially parallel to the road, and the second direction is arranged substantially perpendicular to the road.

4. The lens as claimed in claim 1, wherein each of the first convex surface and the second convex surface is an ellipsoidal surface with a long axis thereof substantially parallel to the first direction, and a short axis thereof substantially parallel to the second direction.

5. The lens as claimed in claim 1, wherein each of the first curved surface and second curved surface is a cylindrical surface.

6. The lens as claimed in claim 1, wherein the light exiting surface further comprises four connecting surfaces arranged at four corners of the light exiting surface respectively, the light converging power of each connecting surface on the first direction is smaller than the light converging power of the first convex surface and the second convex surface on the first direction, the light converging power of each connecting surface on the second direction is larger than the light converging power of the first curved surface and the second curved surface on the second direction.

7. The lens as claimed in claim 1, wherein the light exiting surface further comprises a second concave surface, the second concave surface is arranged at a side of the first concave surface adjacent to the first curved surface, the light converging power of the second concave surface on the second direction is smaller than the light converging power of the first curved surface on the second direction.

8. The lens as claimed in claim 7, wherein the second concave surface is substantially at the center of the first curved surface, the light diverging power of the second concave surface on the first direction is larger than the light diverging power of the first concave surface on the first direction.

9. The lens as claimed in claim 8, wherein the second concave surface is an ellipsoidal surface with a long axis thereof substantially perpendicular to the first direction, and a short axis thereof substantially parallel to the first direction.

10. The lens as claimed in claim 8, wherein the lens is used in a road lamp, the first curved surface is arranged adjacent to the center of the road, and the second curved surface is arranged away from the center of the road.

11. The lens as claimed in claim 1, wherein the light incident surface comprises a first concave curved surface, the first concave curved surface diverges the light accessing therein, the light diverging power of the first concave curved surface on the first direction is larger than the light diverging power of the first concave curved surface on the second direction.

12. The lens as claimed in claim 11, wherein the light incident surface comprises a second concave curved surface and a third concave curved surface, the second concave curved surface and the third concave curved surface intersect each other, and both of the second concave curved surface and the third concave curved surface are arranged in the first concave curved surface, the light diverging power of each of the second concave curved surface and the third concave curved surface is larger than that of the first concave curved surface on both the first direction and the second direction.

13. The lens as claimed in claim 12, wherein the second concave curved surface and the third concave curved surface are connected along the second direction, the second concave curved surface is arranged adjacent to the first curved surface, and the third concave curved surface is arranged away from the first curved surface, the area of the second concave curved surface is larger than that of the third concave curved surface.

14. The lens as claimed in claim 13, wherein the light incident surface further comprises a convex curved surface, the convex curved surface is arranged in the second concave curved surface for increasing the amount of light exiting from the light exiting surface shining towards the side of the lens adjacent to the first curved surface.

15. The lens as claimed in claim 14, wherein the convex curved surface is an ellipsoidal surface with a long axis thereof substantially parallel to the first direction, and a short axis thereof substantially parallel to the second direction.

16. An illumination device comprising:

a light source; and a lens, the lens comprising:

a light incident surface facing the light source, light generated by the lens entering the lens from the light incident surface; and a light exiting surface, the light exiting surface comprising:

a first concave surface located at a center of the light exiting surface for diverging the light exiting therefrom;

a first convex surface and a second convex surface arranged at two opposite sides of the first concave surface respectively for converging the light exiting therefrom, the first convex surface, the first concave surface, and the second convex surface connecting in sequence along a first direction;

a first curved surface and a second curved surface arranged at another two opposite sides of the first concave surface respectively, the first curved surface, the first concave surface, and the second curved surface connecting in sequence along a second direction, the second direction being substantially perpendicular to the first direction;

wherein, the light diverging power of the first concave surface on the first direction is larger than the light diverging power of the first concave surface on the second direction, the light converging power of each of the first convex surface and the second convex surface on the first direction is smaller than the light converging power of each of the first convex surface and the second convex surface on the second direction, the first curved surface and second curved surface diverge the light exiting therefrom on the first direction, and converge the light exiting therefrom on the second direction; and wherein the light exiting surface further comprises a second concave surface, the second concave surface is arranged at a side of the first concave surface adjacent to the first curved surface, the light converging power of the second concave surface on the second direction is smaller than the light converging power of the first curved surface on the second direction.

17. The illumination device as claimed in claim 16, wherein the lens defines a receiving groove for receiving the light source, and the light incident surface is at the bottom of the receiving groove.

18. The illumination device as claimed in claim 17, wherein the receiving groove is arranged adjacent to the first curved surface relative to the second curved surface.

19. The illumination device as claimed in claim 18, wherein the illumination device is used as a road lamp, the first curved surface is arranged adjacent to the center of the road, and the second curved surface is arranged away from the center of the road.

20. A lens comprising:

a light incident surface; and a light exiting surface, the light exiting surface comprising:

a first concave surface located at a center of the light exiting surface for diverging light exiting therefrom;

a first convex surface and a second convex surface arranged at two opposite sides of the first concave surface respectively for converging the light exiting therefrom, the first convex surface, the first concave surface, and the second convex surface connecting in sequence along a first direction;

a first curved surface and a second curved surface arranged at another two opposite sides of the first concave surface respectively, the first curved surface, the first concave surface, and the second curved surface connecting in sequence along a second direction, the second direction being substantially perpendicular to the first direction;

wherein, the light diverging power of the first concave surface on the first direction is larger than the light diverging power of the first concave surface on the second direction, the light converging power of each of the first convex surface and the second convex surface on the first direction is smaller than the light converging power of each of the first convex surface and the second convex surface on the second direction, the first curved surface and second curved surface diverge the light exiting therefrom on the first direction, and converge the light exiting therefrom on the second direction; and wherein each of the first curved surface and second curved surface is a cylindrical surface.

* * * * *